US007596890B2

(12) United States Patent
Francis

(10) Patent No.: US 7,596,890 B2
(45) Date of Patent: Oct. 6, 2009

(54) APPARATUS FACILITATING WALKING IN SKI BOOTS

(76) Inventor: Charles Jelinek Francis, Novobranska 20, Brno (CZ) 602 00

( * ) Notice: Subject to any disclaimer, the term of this patent is extended or adjusted under 35 U.S.C. 154(b) by 673 days.

(21) Appl. No.: 10/565,385

(22) PCT Filed: Mar. 2, 2004

(86) PCT No.: PCT/IB2004/050183

§ 371 (c)(1),
(2), (4) Date: Jan. 20, 2006

(87) PCT Pub. No.: WO2005/018362

PCT Pub. Date: Mar. 3, 2005

(65) Prior Publication Data

US 2007/0051019 A1 Mar. 8, 2007

(51) Int. Cl.
*A43B 5/00* (2006.01)

(52) U.S. Cl. ..... 36/117.4; 36/135; 36/7.5

(58) Field of Classification Search ..... 36/117.3, 36/117.4, 135, 7.5, 7.6
See application file for complete search history.

(56) References Cited

U.S. PATENT DOCUMENTS 3,965,586 A * 6/1976 Roosli ..... 36/7.3
3,971,144 A 7/1976 Brugger-Stuker
4,123,854 A 11/1978 Pasich
4,199,880 A 4/1980 Frey
4,228,602 A 10/1980 Groves
4,286,397 A 9/1981 Booty
4,291,473 A 9/1981 Sartor
4,294,025 A * 10/1981 Keller ..... 36/132
D263,516 S 3/1982 Booty
4,461,104 A 7/1984 Calkin et al.
4,542,599 A 9/1985 Annovi
4,543,738 A * 10/1985 Mower ..... 36/117.3
4,570,363 A 2/1986 Annovi
4,619,059 A 10/1986 Koniuk
4,727,662 A 3/1988 Ilon
4,811,504 A 3/1989 Bunke
4,843,672 A 7/1989 Fasse
4,958,445 A * 9/1990 Brisco ..... 36/7.5

(Continued)

FOREIGN PATENT DOCUMENTS

EP 0036380 9/1981

(Continued)

OTHER PUBLICATIONS website page print: Amazon.com ad for "Seirus Ski Boot Cat Tracks" with description of product.

(Continued)

*Primary Examiner*—Marie Patterson
(74) *Attorney, Agent, or Firm*—Edwin A. Skoch

(57) ABSTRACT

An apparatus (1,2,3,4) that is to be temporarily attached to the soles of ski boots, whenever the wearer is not attached to skis and desires the ability to comfortably walk or desires protection for the sole of the ski boots. The preferred embodiment generally comprises sandal type soles (4) made of a resilient, elastic springy material which aids in the natural walking action by alternately compressing and releasing, adding energy to the step, thereby aiding walking while wearing ski boots.

4 Claims, 2 Drawing Sheets

U.S. PATENT DOCUMENTS

| | | | | | |
|---|---|---|---|---|---|
| 5,154,682 | A | | 10/1992 | Kellerman | |
| 5,243,773 | A | * | 9/1993 | Robic | 36/117.3 |
| 5,481,814 | A | | 1/1996 | Spencer | |
| 5,548,910 | A | * | 8/1996 | Klingseis | 36/135 |
| 5,666,746 | A | * | 9/1997 | Pollard | 36/135 |
| 6,044,578 | A | | 4/2000 | Kelz | |

FOREIGN PATENT DOCUMENTS

| | | |
|---|---|---|
| FR | 701729 | 9/1930 |
| FR | 2810512 | 12/2001 |

OTHER PUBLICATIONS website page print of news story, featuring description of "Walk-Ez Revolutions.".

* cited by examiner

APPARATUS FACILITATING WALKING IN SKI BOOTS

BACKGROUND OF INVENTION

This invention relates primarily to ski boot accessories and devices facilitating more natural ambulation while wearing ski boots, more particularly, attachments to the soles of ski boots that protect those soles and aid in walking while wearing ski boots. The general technical fields involved are footwear sole technology and ski boot technology.

The following represents a list of art referenced in this disclosure:

| Reference: | Issued to: | Date of Issue: |
|---|---|---|
| U.S. Pat. No. 3,971,144 | Brugger-Stuker | Jul. 27, 1976 |
| U.S. Pat. No. 4,199,880 | Frey | Apr. 29, 1980 |
| U.S. Pat. No. 4,228,602 | Groves | Oct. 21, 1980 |
| U.S. Pat. No. 4,286,397 | Booty | Sep. 1, 1981 |
| U.S. Pat. No. 4,461,104 | Calkin, et al. | Jul. 24, 1984 |
| U.S. Pat. No. 4,619,059 | Koniuk | Oct. 28, 1986 |
| U.S. Pat. No. 4,811,504 | Bunke | Mar. 14, 1989 |
| U.S. Pat. No. 6,044,578 | Kelz | Apr. 4, 2000 |

The modern downhill ski boot is meant to rigidly attach flat against the ski surface, so as to provide the wearer with as much control over the ski as possible. Skis and ski boots, while coupled together, essentially act as a single, rigid unit, transferring torques and forces from the point of contact with the snow to the wearer's legs, feet, and ankles.

With this aim in mind, a ski boot is also as rigid as possible, so as to prevent the user's foot from flexing, turning side to side, rocking front to back, or rolling side to side. Further, the ski boot is meant to keep the ankle and foot in a set, acute angle with respect to each other. This is because skiing is best performed with bent knees; bending the knees forces the ankles and feet into an acute angle.

These mechanics are inherently incompatible with the basic mechanics of walking. With each normal walking stride, the feet flex and rock front to back, and the ankle joint flexes freely, allowing the foot-to-ankle angle to change continually through the stride. As such, ski boots perform their skiing task well, but are ill designed for walking. Walking about in ski area parking lots, stairs, ski lodges, sidewalks, and apres-ski snackbars and lounges is a difficult, loud, uncomfortable, and even comic affair.

Further, walking on hard surfaces with ski boots damages the soles of the boots, which are usually made of a rigid plastic, and which can ultimately lead to the need to replace the boots.

Taking the boots off for walking is often not an option because regular footwear is stored away in lockers or left in automobiles. Moreover, taking the boots on and off is cumbersome and time consuming, and it is heavy to carry the boots, and so users often forgo this option.

Many have attempted to overcome this problem using various designs of ski boot soles or ski boot sole attachments. The most common invention in the prior art utilizes a bulky, attached curved or angled lower walking surface that essentially allows the boot to rock back to front over the curved or angled surface. (See, e.g., Groves '602, Booty '397, Calkin '104, Bunke '504.) Another approach has been to alter the sole of the ski boots themselves, to provide for a more natural walking gait, once again using curved or angled surfaces, which, in this case, are fixed onto the bottom of the ski boot.

(See, e.g., Brugger-Stuker '144.) With this second general approach, typically, the boot's sole is mechanically repositioned and the walking surface on the bottom of the boot is physically altered by the user, once the boot is unattached from the ski. Various methods have included flipping a hinged piece down under the boot sole, or moving the boot's sole into a new position.

An inherent problem in the prior art of using attachments or these alterations to ski boots themselves is that the attachments and alterations are bulky because of their curved or angled nature. Curved pieces take up extra room and can make use unnecessarily complicated. Separate curved attachments are hard to stack together, do not stack flat, and take up more room in a backpack or bag.

Another inherent problem in the prior art mentioned above is weight. The materials needed to construct a rigid undersole can be heavy, adding weight to already heavy ski boots and making carrying of the undersoles difficult when not in use. Once again, this added weight makes carrying attachments in a backpack or bag uncomfortable and undesirable.

Similarly, by their rigid nature, curved attachments are more cumbersome to carry than attachments that are flexible and relatively soft. A few have taken the approach of a soft, flexible undersole attachment, such as Koniuk '059 and Kelz '578, but these approaches have their own inherent limitations as well. Kelz '578, in particular, is only designed to help with traction, not the walking motion; they provide no assistance with the motion of walking. The attachment in Koniuk '059, while softer than the prior approaches, sacrifices traction through the use of a curved attachment and adds the problems of bulk mentioned above.

Moreover, the prior art is replete with overly complicated attachment methods, such as front and rear clips. (See, e.g., Frey '880.) The invented apparatus solves the problems inherent in the prior art, as summarized below.

SUMMARY OF INVENTION

This apparatus for walking in ski boots, in its preferred embodiment, is a simple sandal-like attachment to the bottom of ski boots, to be put on while the boots are unattached from skis and the user desires to walk or lounge around in ski boots.

The claimed invention attempts to solve the above-mentioned problems using a simple, lightweight, relatively flat cushion that attaches to the bottom of ski boots, by clipping onto the bottom of the boot. The invention acts like a sandal or pad worn on the bottom of the ski boot, but with important improvements.

The preferred embodiment uses one or more of a myriad of materials, so long as the basic, required functions are satisfied: the material can be compressed under pressure, is sufficiently resilient to return to its original shape when not under pressure, and provides springiness and energy return while returning to its original shape. The material must return to its original shape and width after each step and must be sufficiently durable to act in this function over the desired life of the product and in sustained cold temperatures. Any material must return energy to the wearer while walking, such that the attachment aids in the walking motion by adding springiness to the step.

The attachment's basic material should be an elastomer or elastomeric foam. Although it is not necessary for the invention, suggested materials include polymers like EVA (ethylene vinyl acetate), Neoprene (polychloroprene), or polyurethane foam. Foam can be closed or open cell, depending on manufacturing constraints and/or desired lifespan of the product. These materials are widely commercially available.

The preferred embodiment can be summarized as follows: the upper side of the invented apparatus is flat, and presses flat against the sole of the ski boot. It is held against the sole while attached. The underside of the invented apparatus is also approximately flat. In cross-section, laterally, the invented apparatus is approximately rectangular.

The preferred embodiment is attached using an integrated clipping mechanism at each end of the apparatus. The clipping mechanism, in addition to providing a means of attachment, also provides additional function during the walking motion which increases durability of the apparatus.

The clipping mechanism comprises toe and heel caps which are integrated into the top of the ends of the footbed of the apparatus. The heel cap clasps the rear of the ski boot's bottom and the toe cap clasps the toe end of the ski boot bottom.

The embodiment solves several problems inherent in the prior art. When the invention is not being used, the units can be easily carried by the user, including carrying in a backpack, shoulder bag, or waist bags, or slinging over the shoulder. The relative flatness of the invention makes it easier to carry, by taking up less room, even when two attachments are pressed together.

The prior art, as mentioned above, typically used curved or bulky attachments that remain wide, heavy, and bulky to carry when not in use. The invented apparatus' relative flatness means that unused attachments can be stacked together and carried flat.

Second, since the materials used are lightweight, relatively soft, and flexible, they can be carried comfortably around a skier's waist, in a backpack or bag, or slung over the skier's shoulder.

Third, the embodiment is easily attached to the bottoms of the ski boots and is easily removed. The attachment and removal of the invented apparatus is similar to and as easy as wearing common walking sandals. The method of attachment is easier to learn, easier to repeat, and quicker than even the use of ski bindings because, for example, people are more familiar with using sandals or slippers than the multiplicity of designs of bindings used on skis; and it is easier to use than attachment methods from the prior art for ski boot walking attachments. This way of attaching the apparatus also provides cost and weight savings in construction.

Fourth, the embodiment can be made from inexpensive, commonly available, and lightweight materials, and is easily manufactured. Thus, it can offer the manufacturer a relatively high profit margin while simultaneously being sold inexpensively to the consumer.

The footbed of these embodiments can be made from a multiplicity of readily available injection-molded elastomer or elastomeric foams or other polymer foams, as mentioned above.

Most importantly, the springiness of the undersole material solves the primary problem that is the focus of ski boot walking attachments: it aids the wearer in walking and make walking easier while wearing ski boots.

Basically, the mechanics of walking operate roughly in this fashion: the heel comes down first, compressing the heel portion of the apparatus, and the foot rocks forward as the person moves forward, rolling more weight onto the ball of the foot and toes as the heel rises and uncompresses, thereby compressing the toe portion of the apparatus and rocking forward simultaneously. Then, the user pushes off from the toes and ball of the foot, assisted by the return of the toe portion of the apparatus to its original shape, until the foot completely leaves the ground and is swung forward by the leg.

Illuminating this simple action, the heel of the apparatus compresses when the user first steps down on the heel of the boot. Like a compressed spring, the springy heel material of the apparatus builds potential energy through compression, and that energy is released as the foot rocks forward, thereby pushing upward on the heel, and helping to propel the wearer forward. As the heel comes up, the foot simultaneously rocks forward onto the ball of the foot and toe area. This area of the apparatus likewise compresses as weight is put onto it. As the step completes, the toe portion of the apparatus releases its compressed energy, providing more energy to the user, pushing off during the step's completion.

The alternative embodiment has an additional feature which further facilitates walking in ski boots: the footbed material is slightly thicker in the toe area, which compensates for the angle on the ankle of the ski boot itself. This allows for more comfortable standing and walking while wearing ski boots.

The embodiments have tread on its underside which aids traction on slippery surfaces and snow.

The embodiments utilize an additional feature which extends the lifespan of the apparatus: the toe and heel caps, which serve to attach the apparatus to the boot, also serve to prevent tearing of the footbed material caused by compression during the walking motion.

Lastly, while the apparatus is attached to the sole of the boot, the boot is protected from scratches, gouges, and wear, thus potentially extending the life of the boot.

DETAILED DESCRIPTION

The soles of all common ski boots have a rectangular (when viewed from underneath), flat surface of standard sizes. The length and width of the underside surface is standardized so that the ski boots will fit into standard ski bindings. At each end of the sole, the sole has (when viewed from the side) a thick, squared-off protrusion that extends beyond the end of the ski boot. Standard ski bindings accommodate these protrusions, using them to anchor the ski boot to the ski. The protrusions' thickness top-to-bottom and width side-to-side are standardized, as is the length by which they protrude from the ends of the ski boot. Typically, the heel protrusion is thicker than the toe protrusion, when viewed from the side.

Referring particularly to the drawings, FIGS. 1-3 and 5 show the preferred embodiment of the invention. The apparatus comprises of four basic pieces: one springy, compression footbed, 1, plus one heel cap, 2, and one toe cap, 3, both for attaching the apparatus to the ski boot, and, lastly, an optional, but preferred, treadpiece, 4, covering the bottom of the footbed (as shown in FIGS. 2-5) for traction.

Figure 5:
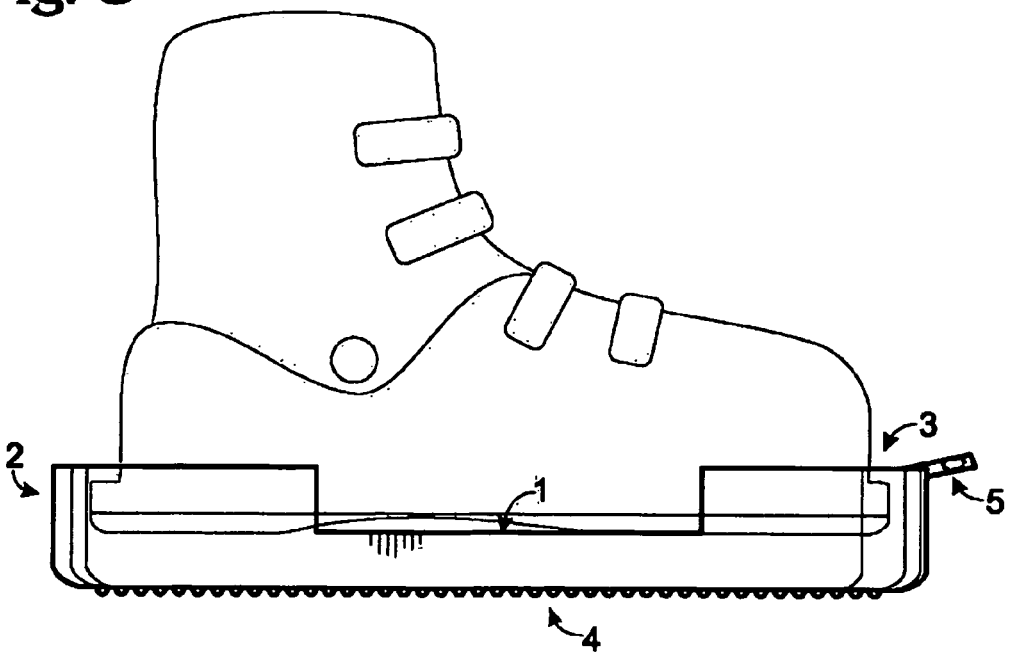
FIG. 5 shows the preferred embodiment, in use, attached to a common ski boot.

By necessity, the ends of the footbed are longer and wider than the sole of the ski boot it will be attached to, so that the ends and the caps can fit around the toe and heel protrusions of the sole of the ski boot. This is best illustrated in FIG. 5, which shows the apparatus attached to a ski boot.

As illustrated in the figures, each end of the footbed, where the heel and toe portions of the footbed are, the footbed's ends rise roughly perpendicular to the main portion of the footbed. These walls curve around the toe and heel of the sole of the ski boot.

Connectedly attached to and integrated with the inside and upper surface of the ends of the footbed, there are a heel cap and a toe cap, 2 and 3, respectively, which cover the inside surface of the ends of the footbed and wrap over the tops of the footbed's ends. Following the rise in the ends of the footbed, the caps rise above the top surface of the footbed and will both grip the toe and heel of the ski boot, as well as protecting them and maintaining the integrity of the footbed during repeated use.

Just as standard ski bindings accommodate the ski boot sole protrusions, so too do the toe and heel caps accommodate the ski boot sole protrusions. The toe and heel caps anchor to the ski boot sole in a similar fashion as ski bindings.

Figure 1:
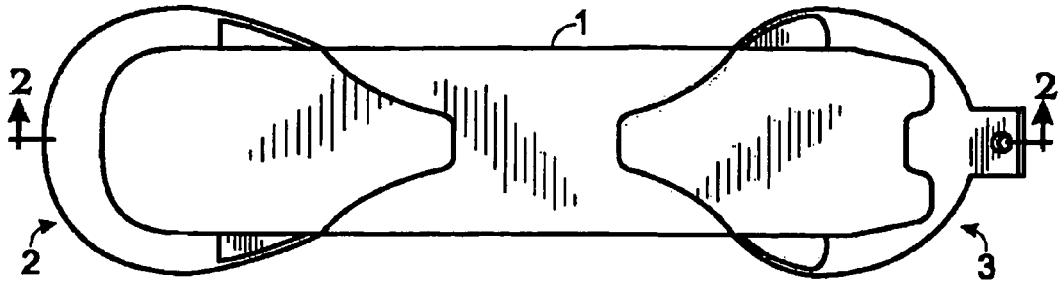
FIG. 1 is a view of the preferred embodiment, from a top-down view.
Figure 2:
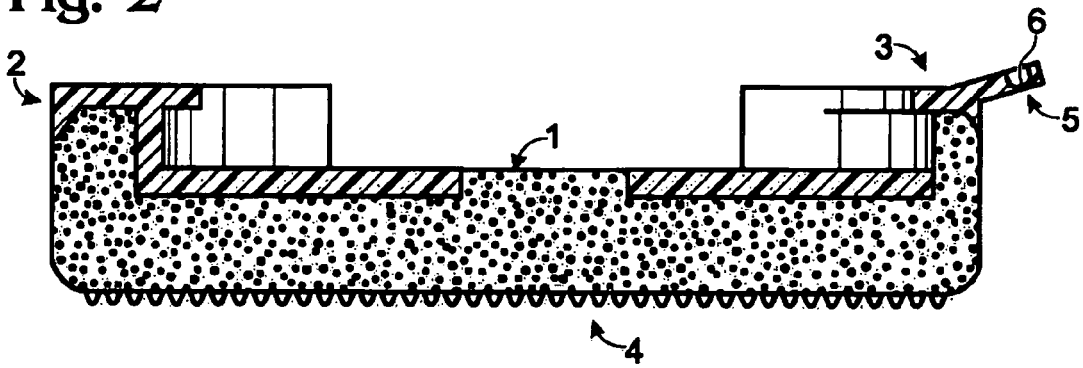
FIG. 2 shows the preferred embodiment of the invented apparatus, viewed from the right side, in cross-section.
Figure 3:
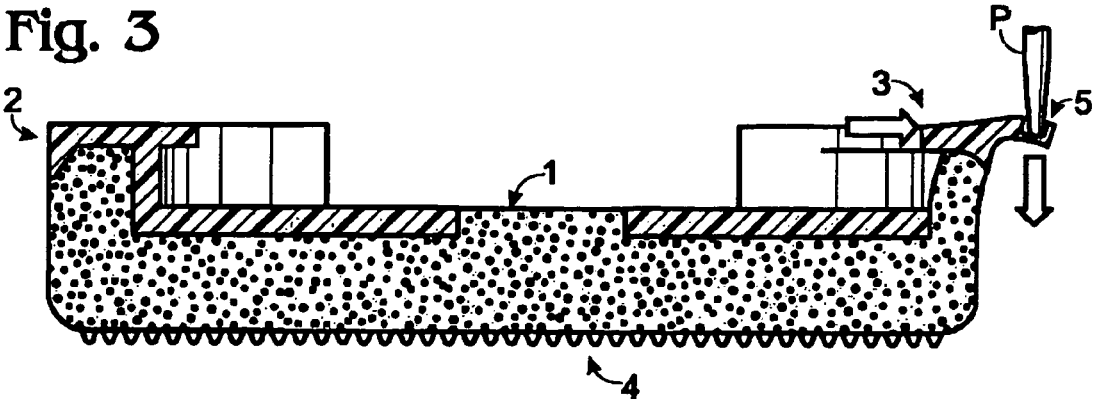
FIG. 3 shows the preferred embodiment of the invented apparatus, viewed from the right side, also in cross-section, showing the actuation and movement of the toe clip, using the tip of a ski pole pushing downward on the toe clip.
Figure 4:
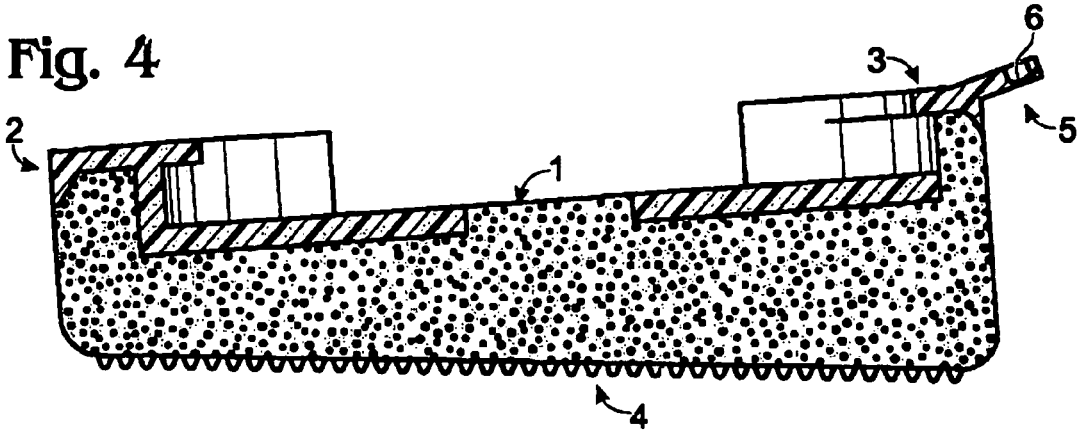
FIG. 4 shows an alternative embodiment, viewed from the right side, in cross-section.

The cap on each end of the footbed is formed such that it has a lip near the top, so that a ski boot sole protrusion fits underneath. In cross-section, as shown in FIGS. 2-4, the lip on each cap makes the inside of the each end of the footbed C-shaped to accommodate and fit against the ski boot sole protrusion. This lip serves to hold the cap and, thus, the footbed against the ski boot sole, as mentioned above.

As mentioned and shown in the figures, the toe cap of the apparatus has a lip, referred to here as a clip, 5, which holds the front end of the apparatus against the toe of the ski boot and also allows for removal of the apparatus from the bottom of the ski boot.

When putting on the apparatus, this toe cap clip is operated by downward pressure, as the ski boot wearer steps into the apparatus. The front protrusion on the toe of the ski boot pushes downward on the clip, thereby pushing it outward. Once the front protrusion of the toe of the ski boot is past the clip, the clip moves or snaps back to its original position, over the top of the front protrusion of the ski boot sole, holding the footbed against the ski boot sole.

As shown in the figures, the front edge of the clip preferably has a portion that serves as a lever used to release the clip. To release the apparatus from the bottom of the ski boot, the user can push downward on the clip; this is shown primarily in FIG. 3. FIG. 3 illustrates how a user might press down on the clip with the end of a ski pole, P, thereby actuating the clip by bending it downward and outward, pulling the clip away from the front edge of the toe of the ski boot sole, and thereby releasing the ski boot from the apparatus.

Particularly evident in FIG. 3, the clip is shown with a small indentation, 6, on its upper surface that accommodates a ski pole, P, for this function.

This extended lever and indentation, while preferred, is not essential to the invention. The same function may be obtained by pushing the clip away from the end of the ski boot.

The exact height, design, and shape of the toe and heel footbed ends and the caps are not crucial, so long as this attachment function is served. Obviously, in order for the apparatus to clip onto the soles of a ski boot, the toe and heel caps' inner dimensions must be tall enough to accommodate the entire top-to-bottom thickness (when viewed from the side) of the protrusions at each end of the ski boot sole. The toe and heel caps' inner dimensions must be wide enough side-to-side to accommodate the width of the protrusions. Note that although typical ski boot sole toe protrusions differ in thickness from typical heel protrusions, this is not illustrated in the figures, for simplicity's sake: in the figures, the toe and heel caps are show with the same height, top to bottom.

The invention can be manufactured to provide a custom fit with particular models of ski boots, or it can come in standard sizes, like the boots themselves. The exact dimensions of the footbed and caps can be varied, so long as they can be made to fit onto the bottom of a ski boot, with the upper, inner surface of the footbed fitting approximately flush, flat against the sole of the ski boot, and the inside of the caps fitting approximately flush against the toe and heel protrusions of the ski boot, as shown in FIG. 5.

The exact shape of the footbed can be varied to fit manufacturing constraints. The central portion of the footbed can be narrower laterally, for design considerations or to save on the cost of materials. Alternatively, the sides of the footbed can be somewhat wider than the sole of the ski boot to provide greater stability laterally. The shape is not essential, so long as the above constraints are met.

The exact construction of the footbed can be varied, and should follow manufacturing constraints. For descriptive purposes and not to imply that the footbed must comprise only a single piece, the footbed is shown in the drawings as a single-unit, relatively flat, elongated roughly rectangular piece, and with rounded ends or walls that curve up over the front and rear of the ski boot, just as the sole of a shoe or the sole of a boot curves up, covering the shoe or boot material at the toe and heel.

Further, although this is not shown in the figures, and not preferred, the caps and footbed may wrap all around the bed, if desirable for manufacturing or aesthetic reasons. This alteration would make the apparatus look similar to a butter dish.

The footbed can be made from one or more of a myriad of materials, so long as the basic, required functions are satisfied. The material can be compressed under pressure, must be sufficiently resilient to return to its original shape when not under pressure, and provide springiness and energy return while returning to its original shape. The material must return to its original shape and width after each step and must be sufficiently durable to act in this function over the desired life of the product and function sufficiently well in cold weather. These required functional attributes are mentioned above and are intended to assist in walking.

Many types of potential materials are commonly commercially available and used in the footwear industry, particularly the running shoe industry. The material must be made of a relatively soft, flexible material which can withstand a wide range of temperatures, and yet maintain its properties of springiness and flexibility. The primary function of the material is to provide springiness while walking. The material should be an elastomer or elastomeric foam. Although it is not necessary for the invention, suggested materials include polymers like EVA (ethylene vinyl acetate), Neoprene (polychloroprene), or polyurethane foam. Foam can be closed or open cell, depending on manufacturing constraints and/or desired lifespan of the product. These materials are widely commercially available and are ubiquitous in the footwear industry.

The caps are constructed of a more rigid material than the footbed. They provide a more rigid connection point for the ski boot than the footbed alone. The materials used in construction of the caps may also be elastomeric or polymer materials, but preferably should not be spongy foam. As with the footbed material, it must function in colder temperatures, and must not be brittle in typical outdoor, winter temperatures. It must be sufficiently flexible to allow for removal and attachment of the apparatus to the ski boot over the desired lifespan of the apparatus, without cracking or breaking, while, at the same time, pressing against the ski boot sole protrusions.

The caps can be molded onto the footbed, or vice versa, or the caps may be glued, sewed, or otherwise permanently attached to the footbed. The caps must be attached to the footbed in such a manner that the pieces will not separate under normal use.

As mentioned, the toe cap and heel cap serve as the inside surface of the footbed at each end. The secondary function of the caps, after serving as the means of connecting the apparatus to the ski boot, is to provide additional durability to the apparatus.

During continued use, without the use of caps, the heel and toe ends of the ski boot sole have the tendency to compress the flat part of the footbed material and cause, over time, damage to the footbed material. More particularly, the ski boot sole's ends would cut into the footbed material where the ends meet the main, flat portion of the footbed. Over time, without the addition of the toe and heel caps, one or both of ends of the footbed could separate from the flat portion of the footbed.

The presence of the caps prevent this separation from occurring because the protrusions on the toe and heel of the ski boot are prevented from cutting into the footbed material. This is an essential and useful function of the caps, and serves as an improvement.

The embodiment can be altered so that the clip is on the rear of the footbed rather than the front. This is not shown in the figures, but would require only the clip lever to be on the rear of the footbed. The function would be identical, but having this feature on the toe end is preferable because it is easier for the user to reach.

FIGS. 2-5 also illustrate how one or more optional, but recommended, treadpieces, 4, can be glued, molded, or sewn onto the underside of the footbed, providing traction on slippery or snowy surfaces. The exact tread design is not crucial to the invention, but the treadpiece(s) should be made of an elastomer which can withstand a wide range of temperatures, and yet maintain the properties of springiness, flexibility, and traction, primarily. Tread materials and designs which can be applied in this invention are commercially available and common in the manufacture of footwear, and, more particularly, hiking boots. Possible materials include blown rubber or synthetic rubber. The treadpieces' material itself can add to the springiness of the footbed, thereby increasing the utility of the apparatus.

An additional, but optional improvement can be made to the invention. The footbed can be made thicker toward the toe end. This alternative embodiment is shown in FIG. 4. This would make the footbed more wedge-shaped and would compensate for the ankle angle present in all ski boots. As noted previously, ski boots are constructed such that the wearer's ankles are bent, rather than straight, thus reinforcing a crouched, knee-bent position while skiing. Since this ankle angle makes for more difficult walking, thickening the footbed toward the toe compensates for this unnatural ankle angle.

The exact shape, position, and thickness of the additional material in the toe area of the footbed is not essential, so long as the basic purpose is maintained. Preferably, the thickening should not change the flat nature of the underside or upperside of the footbed. The preferable thickening is shown in FIG. 4, with an angle of less than fifteen degrees from parallel. That is, since most ski boots have an ankle-to-foot angle of fifteen degrees or less, it is preferable to have the angle between the upper and underside of the footbed to be less than fifteen degrees. FIG. 4 shows an angle of approximately five degrees, merely for illustration. In contrast, in the primary embodiment, the upper and undersides of the footbed are approximately parallel.

This improvement is also an improvement over the prior art in the sense that the underside of the footbed is flat against the ground. Flat contact with the ground along the length of the footbed is an improvement because it allows for much greater traction than attachments in the prior art which use an arch or angle that is rotated over. The greater traction is accomplished because of the greater surface area in contact with the ground during the walking motion and the added stability of a larger, flat walking surface.

I claim:

1. An apparatus that attaches to the underside of ski boots that assists walking while wearing ski boots, comprising:

a. a footbed being roughly flat from heel to toe made from resiliently elastic material that adds springiness to the walking motion; and b. an attachment means at the front and rear of said footbed for removably attaching said footbed to the underside of ski boots, said attachment means further comprising:

c. a connectedly-attached clip at one end of said footbed which engages the front or rear edge of the sole of a ski boot; and d. a connectedly-attached lip of rigid material on the inside opposite end of said footbed, opposite said clip, which fits over the upper edge of the end of a ski boot's sole; and, e. said footbed being capable of flexing and returning to its original shape such that said clip and said lip can be attached over, and removed from, said upper edge of said ends of a ski boot's sole.

2. An apparatus that attaches to the underside of ski boots that assists walking while wearing ski boots, comprising:

a. a footbed made from resiliently elastic material that adds springiness to the walking motion, said resiliently elastic material comprised of one or more members of elastomeric material connectedly attached together; and b. said footbed being roughly flat from heel to toe; and c. said footbed having an attachment means for removably attaching said footbed to the underside of ski boots; and d. said footbed being capable of flexing and returning to its original shape such that said attachment means can attach and unattach from said underside of said ski boots, and e. an elastomeric tread connectedly attached to the underside of said footbed, which provides traction while walking.

3. The apparatus, as in claims 1, or 2, said attachment means further comprising:

a. a clip at one end of said footbed which engages the front or rear edge of the sole of a ski boot; and b. a lip of rigid material on the inside opposite end of said footbed, opposite said clip, which fits over the upper edge of the end of a ski boot's sole.

4. The apparatus, as in claims 1, or 2, said attachment means further comprising a rigid heel cup and a rigid toe cup each connectedly attached to said footbed at each end of said footbed, said cups capable of fitting around the protruding ends of a ski boot sole and gripping said ski boot sole.

* * * * *